US005216826A

United States Patent [19]

Chaigne et al.

[11] Patent Number: 5,216,826

[45] Date of Patent: Jun. 8, 1993

[54] ALPINE SKI BOOT

[75] Inventors: Jérôme Chaigne, Saint Jorioz; Bernard Nerrinck, La Balme de Sillingy, both of France

[73] Assignee: Salomon S.A., Annecy Cedex, France

[21] Appl. No.: 795,529

[22] Filed: Nov. 21, 1991

[30] Foreign Application Priority Data

Nov. 22, 1990 [FR] France ..... 90 14838

[51] Int. Cl.[5] ..... A43B 5/04

[52] U.S. Cl. ..... 36/117; 36/120; 36/121

[58] Field of Search ..... 36/117, 118, 119, 120, 36/121

[56] References Cited

U.S. PATENT DOCUMENTS

| | | | |
|---|---|---|---|
| 3,696,534 | 10/1972 | Hornung | 36/121 |
| 3,832,792 | 9/1974 | Kastinger | 36/117 |
| 3,939,582 | 2/1976 | Garbuio | 36/117 |
| 4,577,420 | 3/1986 | Petrini et al. | 36/117 |
| 4,809,448 | 3/1989 | Tonel et al. | 36/120 |
| 5,054,215 | 10/1991 | Tonel et al. | 36/117 |

FOREIGN PATENT DOCUMENTS

| | | |
|---|---|---|
| 1964370 | 7/1971 | Fed. Rep. of Germany . |
| 2404447 | 8/1974 | Fed. Rep. of Germany . |
| 2404233 | 4/1975 | Fed. Rep. of Germany . |
| 2358119 | 2/1978 | France . |
| 1295960 | 11/1972 | United Kingdom . |

OTHER PUBLICATIONS

French Search Report and Annex.

*Primary Examiner*—Paul T. Sewell
*Assistant Examiner*—Marie D. Patterson
*Attorney, Agent, or Firm*—Sandler, Greenblum & Bernstein

[57] ABSTRACT

A rear entry alpine ski boot, in which the rear spoiler is latched on the sides of the upper. The rear spoiler of the boot has an indent in its rear portion, the indent extending along a plane intersecting a plane passing by its latch on the upper and its pivot on the lower shell and determining an upper segment journalled on latch and lower segment journalled on pivot.

14 Claims, 5 Drawing Sheets

ALPINE SKI BOOT

BACKGROUND OF THE INVENTION

1. Field of the Invention

The present invention relates to ski boot of the "rear entry" type, wherein the rear spoiler of the upper can be latched into a skiing position on the upper. More particularly, the invention is related to a control device for the flexion of the upper with respect to the lower shell.

2. Description of Background and Other Information

The aforementioned type of ski boot generally comprises a rear spoiler journalled on the lower shell in the zone corresponding to the heel, and latchable into the skiing position on the upper so as to maintain the lower leg of the skier, and closure means of the "cable-track" type, linking it to the front portion of the upper. In these boots, it is the front portion of the upper that enables the force and the amplitude of the flexion movements transferred to the upper and directed in the longitudinal axis of the boot to be controlled.

Therefore, when the upper is biased to flex, the front portion is displaced and/or is deformed by a certain amplitude in the direction of flexion, simultaneously driving the rear spoiler that then pivots on its journal located in the heel zone. Since this journal is offset towards the base with respect to the flexible zone and/or the deformable zone of the front portion of the upper, which extends to the level of the top of the foot and of the flexion fold of the leg of the skier, the result is a relative sliding between the rear spoiler and the front portion of the upper. This sliding is most substantial at the area of the upper edge of the upper and especially at the area of the edge of the rear spoiler in contact with the rear portion of the lower leg of the skier, due to the fact that it is the furthest portion of the rear spoiler from the journal of the latter. Since the sliding is produced when the closure means ensure close contact of the rear spoiler against the lower part of the leg, the skier experiences a rubbing sensation that can be more or less painful.

Moreover, such a concept of the upper of the boot does not enable the journal zones of the skier's ankle to be respected, as this is located at the level of the malleoli. Also, it can be noted that in this type of boot, the resistance of the upper in rearward flexion lacks firmness due to the fact that it is the front portion of the upper that alone controls the general flexion of the latter, and the fact that the closure means yet again amplify this lack of firmness.

This disadvantage is solved in other known rear entry ski boots, where the rear spoiler is equipped with nesting elements on its wings, that cooperate with the corresponding portions located on the sides of the upper, thus forming a latch that stops all relative movement of the rear spoiler with respect to the front portion of the upper in the longitudinal direction of the boot. However, due to this immobilization, the flexion possibility of the upper becomes very limited, even inadequate for satisfactory skiing practices, because the flexion possibilities of the ankle of the skier are limited too much.

Other rear entry ski boots are also known, including a type in which a rear spoiler is equipped with means that enable, on the other hand, relatively substantial frontward flexion, but no flexion at all towards the rear. The ski boot described in French Patent Application No. 2,358,119 is an example of this type of boot. As disclosed, it is by virtue of a segmentation of the rear spoiler that this spoiler is able to follow the lower part of the skier's leg during frontward flexion, and is able to retain the latter towards the rear from its initial position of closure of the upper, the rear spoiler behaving like "a lobster's tail". However, this type of boot has some of the disadvantages that have been described previously. Indeed, on the one hand, the relative sliding of the rear spoiler with respect to the rear portion of the lower leg of the skier during its flexion is not avoided because the segmentation of the rear spoiler is not centered on the pivot axis of the ankle, and on the other hand, the pivot axis of the upper does not respect that of the ankle of the skier. Also, due to the fact that the retention of the rear spoiler with respect to the front portion of the upper is basically done by means of closure means that link this front portion to the rear spoiler, the resistance of the upper in rearward flexion lacks firmness, and, at the very least, varies in accordance with the closure forces of the upper on the lower leg of the skier.

SUMMARY OF THE INVENTION

It is an object of the present invention to overcome the disadvantages in previously known boots in a very simple and efficient manner, by reducing the relative sliding of the rear spoiler with respect to the rear portion of the lower leg of the skier, by substantially centering the rotational axis of the upper with that of the ankle in the zone of the malleoli, and by ensuring a firm rear rest that has no factor tending to limit the amplitude of the frontward flexion of the upper.

According to the invention, the ski boot is of the rear entry type, whose upper comprises a rear spoiler linked to the lower shell by means of a pivot located in the heel zone. This rear spoiler has two wings, each of which is provided with a latching means, cooperating with the sides of the upper in the zone corresponding to the malleoli. A closure device maintains the wings of the rear spoiler in position on the sides of the upper on the latching means, and links of the rear spoiler with the front portion of the upper in the manner of a belt.

The boot of the invention provides that the rear spoiler has at least one transverse indent opened towards the exterior of the boot, on the side constituting the rear portion of the upper, and by the fact that this indent extends along a certain depth along a plane intersecting with another plane passing by the latching and journal means of the rear spoiler on the lower shell. The indent is thus oriented in the direction of the lower edge of the wings of the rear spoiler, and, according to its depth, leaves behind a length of wall of the wings, more or less substantial between its base and the lower edge of the wings. This remaining wall length thus forms a material "bridge", located in the extension of the indent, which thus determines, on the one hand, one upper segment journalled on the latching means in the zone of the malleoli, and on the other hand, one lower segment journalled on the pivot of the rear spoiler in the heel zone, the two segments remaining connected to each other by the material bridge. In such an embodiment, the lower segment constitutes, by its upper edge contiguous to that of the lower edge of the upper segment, an abutment that stops all rearward pivoting of the upper segment, as soon as the edges are in contact.

Moreover, according to the invention, the latching means of the wings on the sides of the upper boot is equipped with an arrangement enabling its rotation about itself with respect to the sides of the upper or enabling the rotation of the upper segment on it. In both of the embodiments mentioned hereinabove, the latching means act as a pivot to the upper segment with respect to and on the sides of the upper.

Moreover, according to a preferred embodiment, the lower shell of the ski boot has two relatively rigid vertical extensions that extend upwardly on both sides of the upper of the boot, and that form the sides of the upper with which the latching means of the wings of the spoiler cooperate. In this way, when the upper of the boot is closed during skiing, the rear spoiler is blocked in a front-to-rear position by means of its pivot axis located in the heel zone, by its latching means on the vertical extensions coming from the lower shell, and by its upper and lower segments being placed in abutment along their contiguous edges; the closure device of the upper ensuring assembly and maintenance of the component parts of the upper with each other, it is the upper of the boot that is thus stopped in its entirety from making any flexion in the front-to-rear direction. However, when the upper is biased to flex in the rear-to-front direction, the rear spoiler is pulled to the front by means of a closure device that links it to the front portion of the upper, and consequently, because of the total immobilization of the lower segment held between the pivot of the rear spoiler and the latching means, it is the upper segment that is pivotally connected on its latching means against the resistance to flexion that the "material bridge" can present, the bridge subsisting between the base of the indent and the lower edge of the wings of the rear spoiler.

It is clear that the bigger the material bridge, and less flexible the material used, the greater the resistance to pivoting of the upper segment on the latching means that acts as the pivot. Also, according to the orientation given to the indent with respect to the plane passing by the pivot and by the latching means of the rear spoiler, and according to its greater or lesser proximity to the pivot or the latching means, the resistance of the material bridge to the pivoting of the upper segment, as the clearance amplitude allowed will be more or less substantial.

It becomes clear that such a construction of the boot and its rear spoiler enables the rotational axis of the upper to be recentered, and especially of the upper segment of the upper that encircles the lower portion of the leg of the skier, substantially corresponding to the journal of the ankle; also, because of the implementation of the indent the ease of rear entry is conserved, with, moreover, the guarantee of a firm front-to-rear retention and an easily controllable rear-to-front flexibility both from the points of view of force and amplitude. To this end, it is possible to make an indent whose edges are contiguous or separated by a certain value. In the latter case, the upper segment is thus authorized to undertake a slight pivoting in the front-to-rear direction until the edges come into contact.

Once again, and still without going beyond the scope of the invention, it is possible to envision that the indent be adjoined by an element limiting the possible distancing. In one embodiment of this type, the limitation element is constituted by a rigid closed ring extending on both sides of the opening of the indent in the rear portion of the rear spoiler; this ring is provided on the one hand, to be retained on each of its upper and lower segments thus connected to each other by the ring, and on the other hand, to be slidably mounted in a slot on at least one of these segments; the slot in this case, has a predetermined length fixing the maximum spacing allowed of the edges of the indent when the upper is flexed frontwardly, the latter being thus limited in clearance in the same direction.

According to a variation of the embodiment of the invention, the indent has edges that are distanced from one another, and a filler element is provided to be engaged in it to fill up the space left free between its edges. According to the result desired, the filler element is provided to be rigid, or on the contrary, elastically compressible; in the first embodiment, a rear spoiler is obtained that has no possibility of front-to-rear flexion, and in the second case, a rear spoiler is obtained in which the upper segment is equipped with the possibility of flexion in accordance with the compressibility of the filler element. Moreover, according to a special embodiment, this filler element is advantageously provided with nesting means and/or retention means on the rear spoiler enabling it to be detached in view of being replaced. Thus, when the skier desires a firm rear rest, all that need be done is to put a rigid filler element in place, and inversely, for a relatively flexible rear rest, a compressible filler element may be used.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which:

FIG. 1 shows the boot from a rear three-quarter perspective view, and especially the rear spoiler provided with a flexion indent;

FIGS. 2 and 3 are side views of the boot of FIG. 1, seen from top, respectively in the initial skiing position (FIG. 2) and in the rear-to-front flexion position (FIG. 3);

DETAILED DESCRIPTION OF THE PREFERRED EMBODIMENTS

Figure 2:
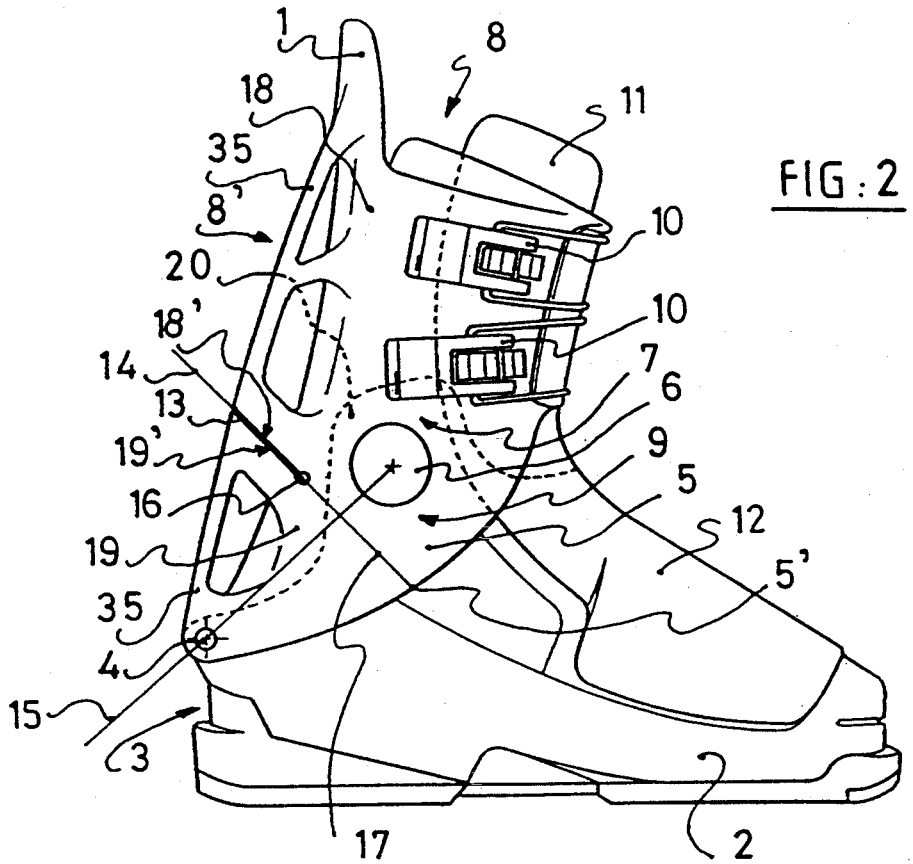
FIGS. 1–3 represent a ski boot according to a first embodiment of the invention.
Figure 1:
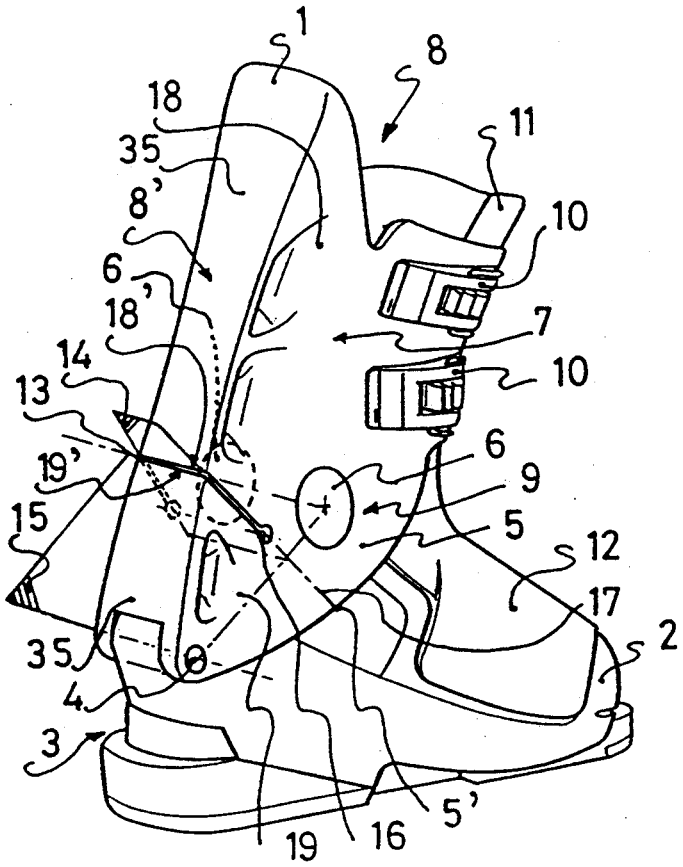
Figure 3:
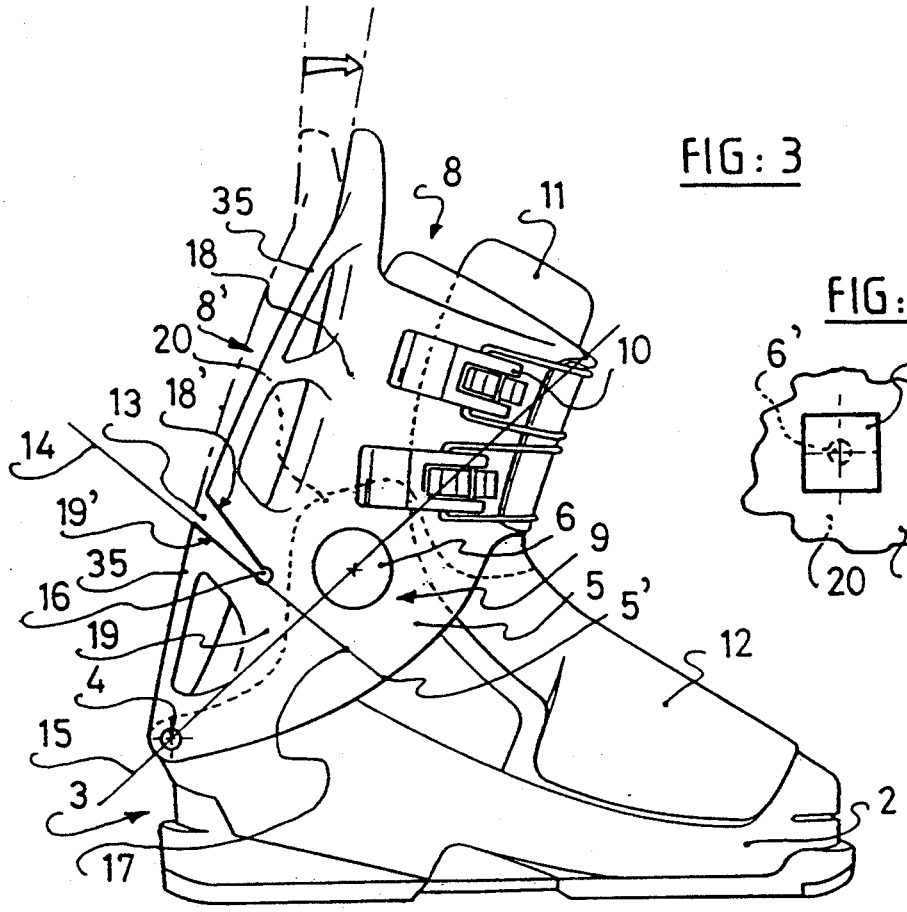

The ski boot of the present invention, as illustrated in FIGS. 1–3, is of the rear entry type, and its upper 8 especially consists of a rear spoiler 1 that is connected to the lower shell 2 in the zone of the heel 3 by means of a pivot 4. This rear spoiler 1 has two wings 5, each of which are provided with a latching means cooperating with the side 7 of the upper 8 in the zone 9 corresponding approximately to the malleoli of the skier. A closure device 10 maintains the wings 5 of the rear spoiler 1 on the sides 7 of the upper 8 in position on the latching means 6, and connects the rear spoiler 1 with the front portion 11 of the upper 8.

In this embodiment of the boot, the wings 5 of the rear spoiler 1 extend towards the front of upper 8 and at least partially cover the front portion 11 of the upper, that they tighten like a collar, by means of a closure device 10. This front portion 11 of the upper 8 is obtained here from a front cuff 12 that covers the top of the foot, but may also be obtained in an integral manner with lower shell 2.

According to the invention, the rear spoiler 1 is made with an indent 13, called "the flexion" indent. This flexion indent 13 is open towards the exterior of the boot on the side 8' constituting the rear portion of the upper 8, and extends along a plane 14, intersecting plane 15 that passes by latching means 6 on each side 7 of the upper, and by pivot 4 of the rear spoiler 1. The indent 13 is thus oriented in the direction of the lower edge 5' of wings 5, and leaves behind, according to its depth a wall length of the wings that is more or less substantial between its base 16 and the edge 5'. This wall length constitutes a material bridge 17 that is located in the extension of the indent 13, the indent thus determining, on the one hand, an upper segment 18 journalled on the latching means 6, and on the other hand, a lower segment 19 journalled on pivot 4 of rear spoiler 1. As the upper 18 and lower 19 segments remain linked to each other by means of material bridge 17, the rear spoiler I can be maneuvered during opening and closing of upper 8 of the boot in the same way as if it were not segmented, that is, like in a traditional rear entry ski boot, of the type including latching of the rear spoiler on the upper. Moreover, when upper 8 is closed during skiing by means of a closure device 10, the rear spoiler 1 is blocked in the front-to-rear position by means of its pivot axis 4, and by means of its latching means 6 on sides 7 of the upper, and by the upper and lower segments 18 and 19 being placed in abutment along their contiguous edges, respectively 18' and 19'.

On the contrary, by virtue of the indent 13 obtained in the rear portion 8' of rear spoiler 1 along a direction intersecting, or perhaps even approximately perpendicular, to plane 15 of retention of the latter on its pivot 4 and its latching means 6, the upper segment 18 is capable of pivoting in the rear-to-front direction; indeed, in FIG. 3, when upper 8 is biased frontwardly under the action of the leg of the skier, the rear spoiler 1 is pulled in the same direction, and due to the fact that its lower segment 19 is completely immobilized by pivot 4 and latching means 6, only upper segment 18 is subject to flexion. The latter element thus pivots on latching means 6 and brings about the spacing of edges 18' and 19' of indent 13 against the more or less elastic resistance of material bridge 17 that is left between the base of the indent and the lower edge 5' of wings 5.

Figure 3A:
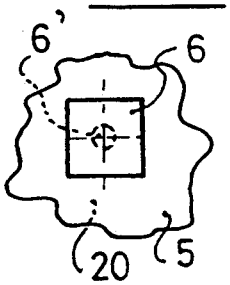
FIG. 3*a* shows an enlarged view of the latching means.

The possibility of flexional movement of the upper segment 18 on the latching means 6 is subordinate to certain arrangements. Thus, on the one hand, the latching means 6 is advantageously constituted of two nesting parts whose contour is circular, one having projection, and other a hollow, and on the other hand, the latching means 6 cooperates with two relatively rigid vertical extensions 20 coming from lower shell 2, that forms the sides of upper 8. By these arrangements, the upper segment 18 is thus capable of turning on latching means 6, which acts as a pivot for it, the pivot cooperating with extensions 20 of lower shell 2, remains practically fixed in position despite the flexion efforts that tend to lower it. Also, rather than provide nesting parts with circular contours for latching means 6, it can also be envisioned, as is visible in FIG. 3*a*, that means 6 be made to pivot about itself by means of a journal 6', for example, linked to an adjacent extension 20, coming from lower shell 2.

Figure 4:
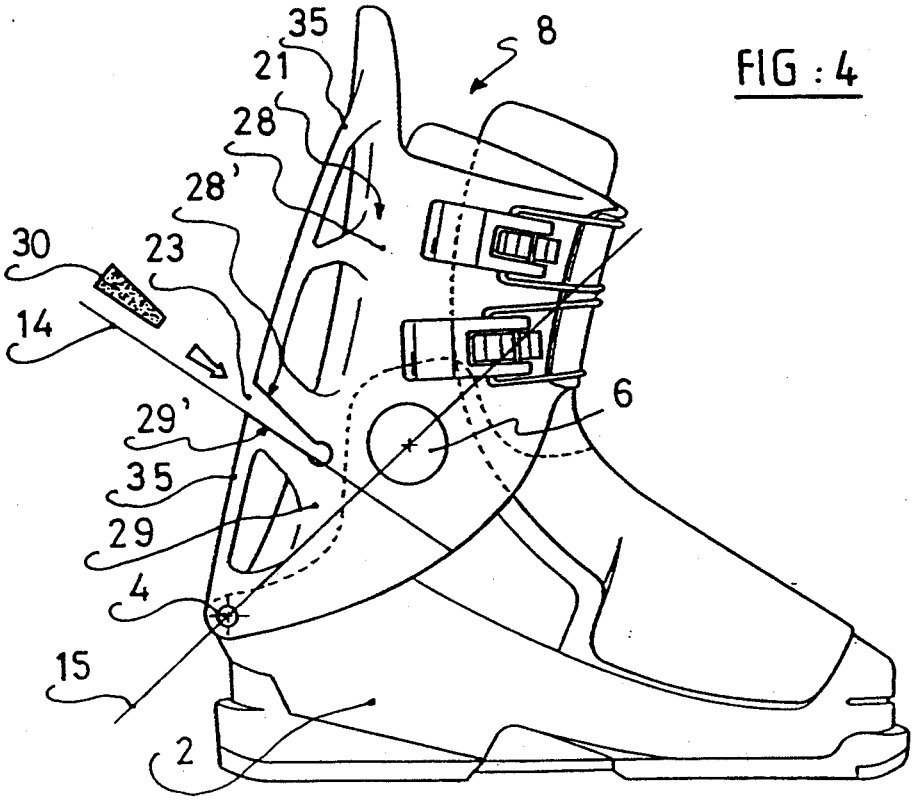
FIG. 4 illustrates another embodiment of the boot according to the invention, wherein a rear spoiler has an indent whose edges are distanced from another in the initial skiing position, and in which a filler element may be introduced.

According to another embodiment of the boot, still within the scope of the invention, as illustrated in FIG. 4, indent 23 has its edges 28', 29' that are relatively distanced from another when rear spoiler 21 is in the initial latching position on the upper 8 of the boot. In this embodiment, the upper segment 28 is thus capable of a certain amount of rearward flexion with respect to the lower segment 29 in accordance with the spacing of edges 28' and 29', and limited by these edges being placed in abutment, as is shown in FIG. 5; as in the case of frontward flexion, the upper segment 28 remains journalled on the latching means 6 located in the zone corresponding approximately to the malleoli.

Figure 5:
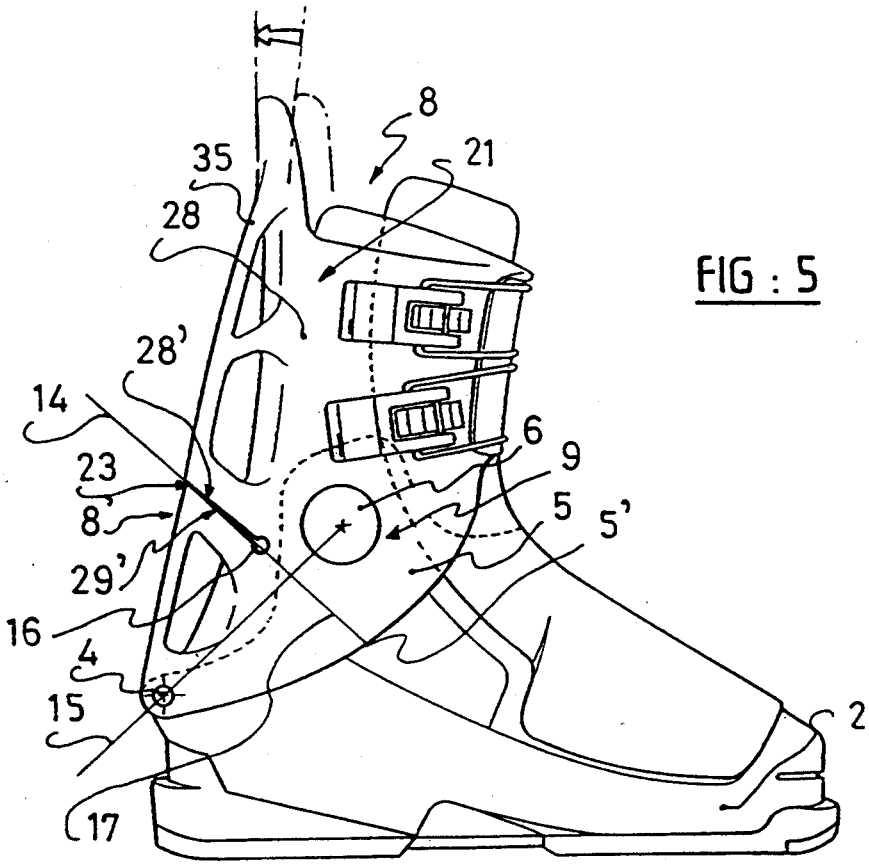
FIG. 5 shows the boot of FIG. 4 when the upper of the latter is biased in an extreme position of front-to-rear flexion.

According to yet another embodiment, illustrated in FIGS. 4 and 5, indent 23 may be adapted to receive a filler element 30 that fills the space left free between its edges 28' and 29'. By this arrangement, and according to the mechanical characteristics of this filler element 30, a rear spoiler 21 is obtained that is capable of offering a front-to-rear rest that is more or less firm; indeed, when the filler element 30 is made of a rigid material, a rear spoiler 21 whose upper segment 28 is stopped from making any rearward pivoting is obtained. On the other hand however, when the filler element 30 is made of an elastically compressible material, the upper segment 28 is permitted to undertake a certain amount of pivoting in accordance with the compressibility of the material. Advantageously, this filler element 30 is adapted in a removable manner on rear spoiler 21, and has retention means by nesting, adhesion, etc. . . . ; thus, for a given ski boot comprising a rear spoiler 21, the possibilities of front-to-rear flexion can be varied according to the technique of the ski of the skier.

Figure 7:
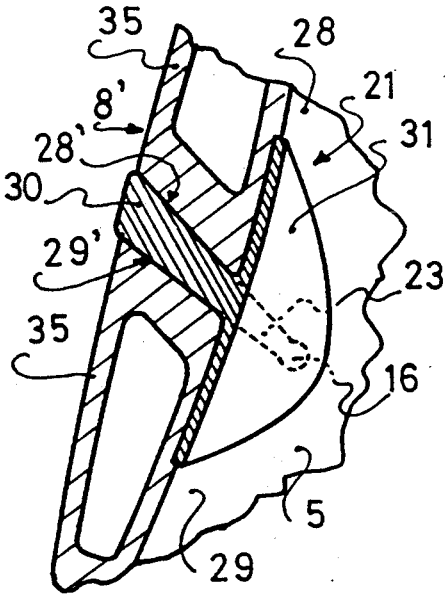
FIGS. 6 and 7 illustrate details of the rear spoiler, as seen in a longitudinal section, and especially, means enabling the indent zone to become impermeable.
Figure 6:
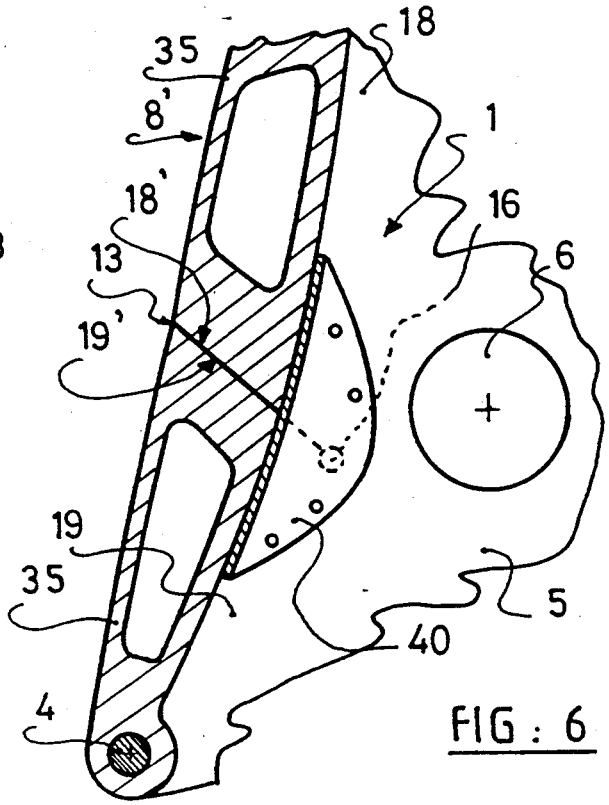

In the embodiment of an indent having contiguous edges 18'-19', or an indent 23 whose edges 28'-29' are separated, it is necessary to incorporate sealing parts or means so as to avoid possible penetration of snow, water, etc. from the outside of rear spoiler 1-21 towards the interior of upper 8, especially during skiing, when the upper segment 18-28 pivots frontwardly, resulting in the opening of the indent. First, as shown in FIG. 6, a rear spoiler 1, seen in a longitudinal section, is equipped with a sealing membrane 40. The indent 13 being adapted to open more or less, this membrane 40 is provided of an elastic material and fixed by any appropriate known retention means, such as adhesion, welding, riveting, etc. In the example of FIG. 7, indent 23 whose edges 28'-29' are separated, is blocked by a filler element 30, a packing collar 31 covering indent 23 extending from the inner side of rear spoiler 21, the packing collar advantageously constituting retention means of the element on the spoiler. Once again, this packing collar 31 may be fixed by any known means mentioned previously. Also, these sealing means and parts 40 and 31 may be made such that they nest in the corresponding parts obtained on the rear spoiler.

Figure 8:
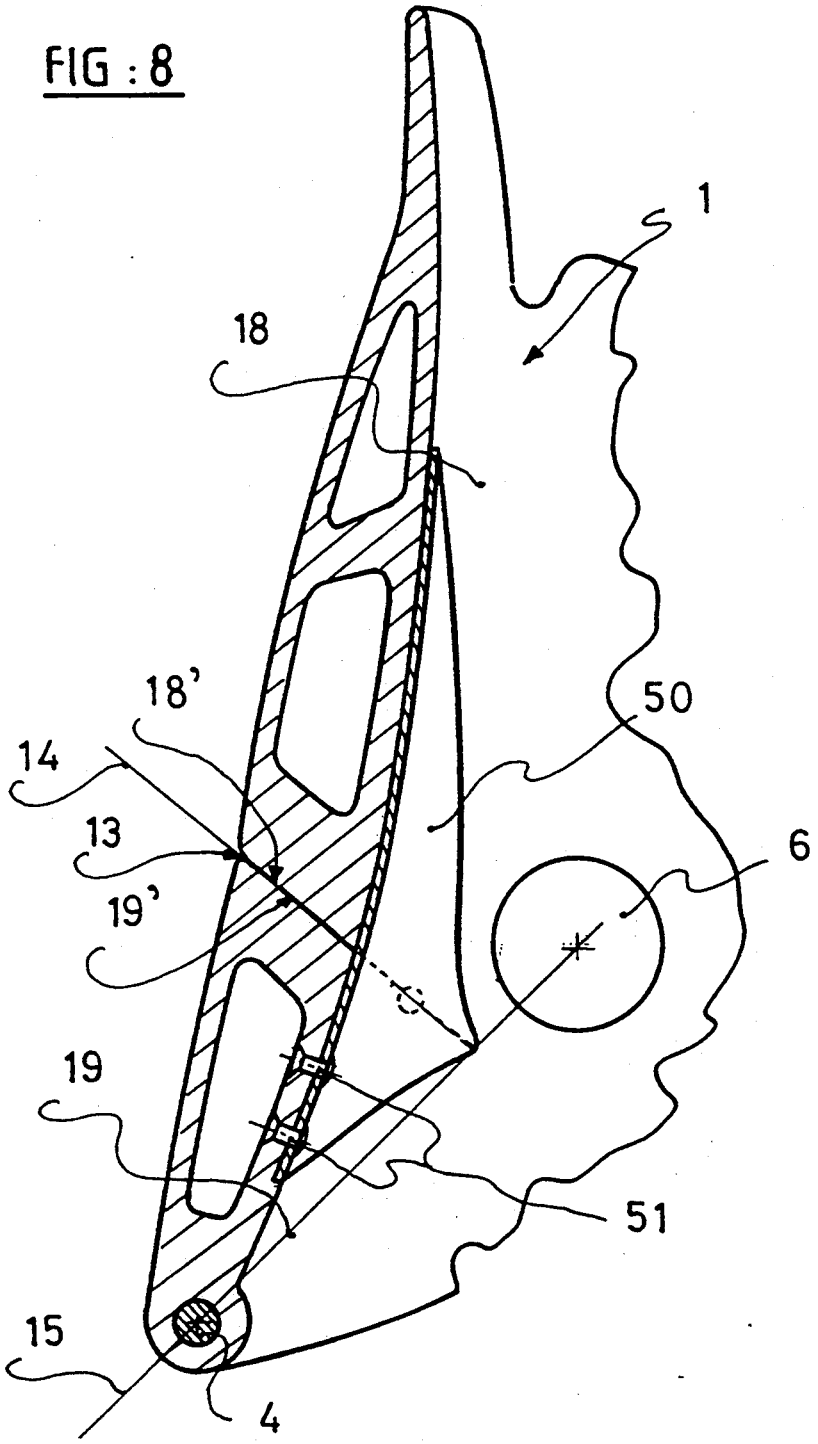
FIG. 8 shows a variant of the embodiment of the sealing means of the indent.

In the example represented in FIG. 8, the sealing means 50 is constituted of a flexible plate in the form a gutter that is affixed to the lower segment 19, and that extends inside the upper segment 18. This type of construction enables impermeability to be achieved, and also, in accordance with the chosen flexibility of means 50, it enables resistance to frontward flexion of the upper segment 18 to be changed without modifying the initial characteristics of indent 13.

An entire range of means 50 is contemplated whose resistance to flexion ranges from weak to strong, and make them removable by bindings 51. Thus, for a given type of boot, the flexion forces of the upper can be varied in accordance with the skier.

Finally, and without going beyond the scope of the invention, several indents 13 and/or 23 can be made in rear spoiler 1, 21, and they can be located between pivot 4 of the spoiler and latching means 6, so as to guarantee the pivoting of upper segment 18 and/or 28 on the latching means 6.

As can be seen in FIGS. 1–7, rear spoiler 1, 21 may be equipped with a rigidifying element 35 that extends in the vertical direction on the rear portion 8' of the spoiler, of upper segment 18, 28 up until lower segment 19, 29, on both sides of indent 13, 23, without leaving the scope of the invention.

Figure 9:
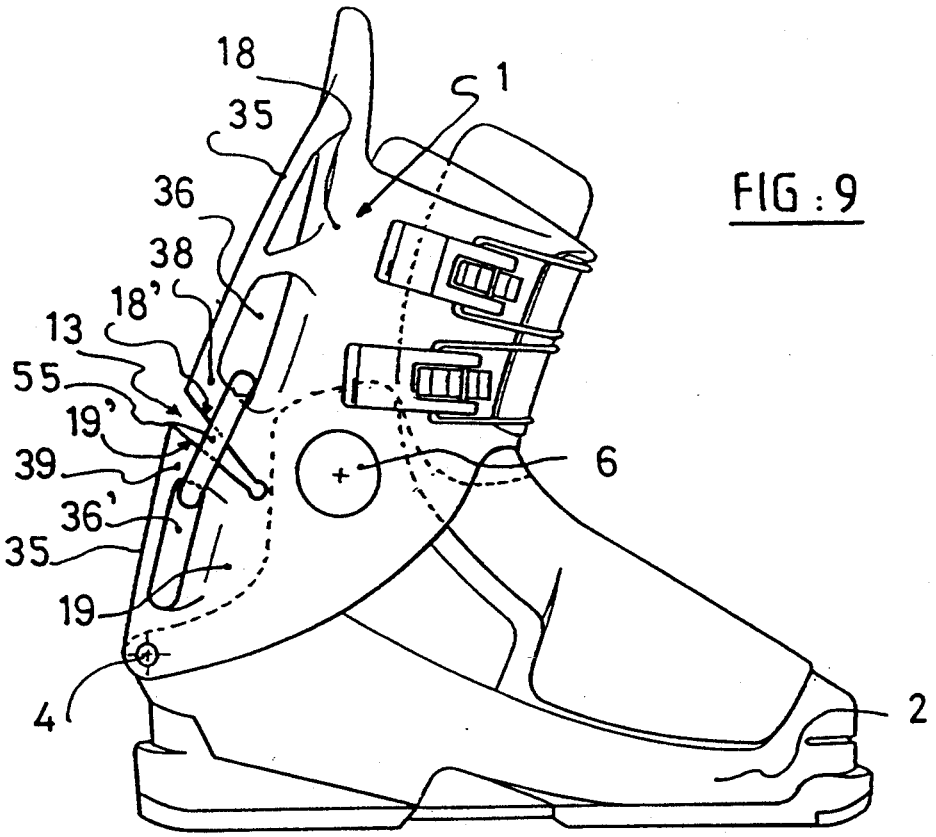
FIGS. 9 and 10 illustrate a boot according to the invention provided with an element limiting the frontward pivot amplitude of the upper associated to the indent.
Figure 10:
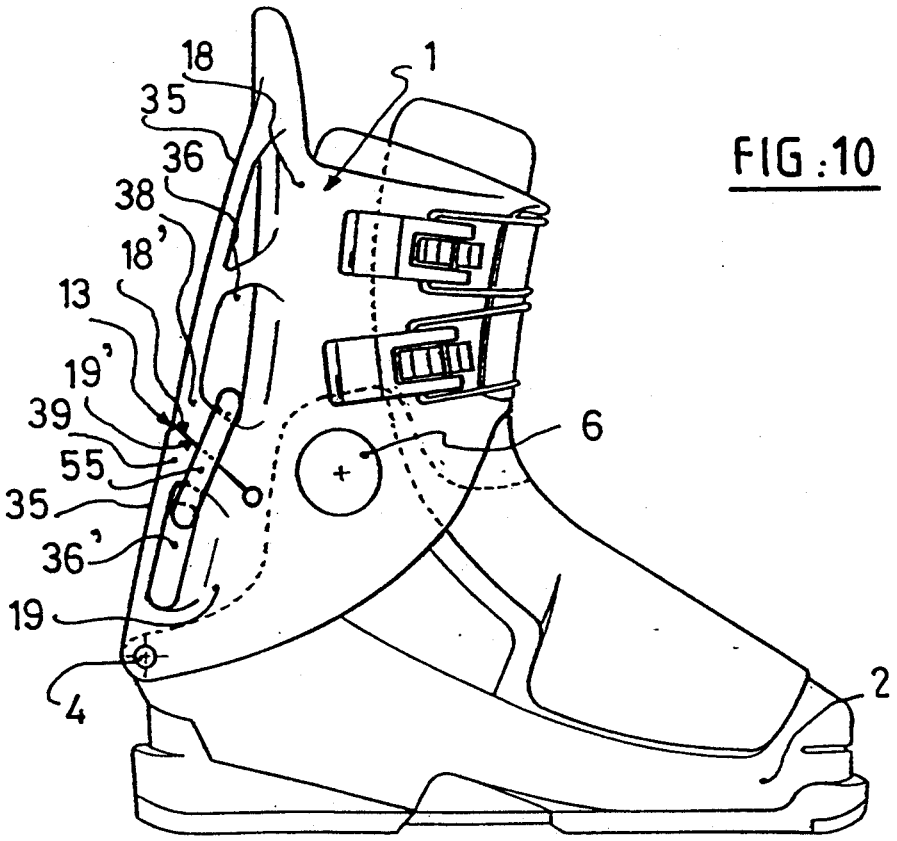

According to a variation of the embodiment of the invention, as represented in FIGS. 9 and 10, an element 55 is provided, adjacent to indent 13, that limits the possible distance of its edges 18', 19' defining the upper 18 and lower 19 segments. Advantageously, this element 55 is constituted of a closed rigid ring that extends on both sides of edges 18', 19' of indent 13, and is retained on segments 18, 19 in the zone of rigidification element 35. In the example represented, the rigidification element 35 has two slots or longitudinal recesses 36, 36' closed by a shoulder 38, 39 at least on the corresponding side to edges 18', 19'. Ring 55 is thus capable of sliding in one and/or the other of these recesses 36, 36' until it comes in abutment on shoulder 38 and 39 of these recesses, as is illustrated in FIG. 10, and limits the pivot amplitude of upper segment 18 on a latching means 6 in the rear-to-front direction.

The instant application is based upon French patent application 90.14838 of Nov. 22, 1990, the disclosure of which is hereby expressly incorporated in its entirety by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. Rear entry ski boot, said ski boot comprising a rear spoiler linked to the lower shell by means of a pivot located in the heel zone, said rear spoiler having two wings that are each provided with a latching means cooperating with the sides of the upper in the zone corresponding to the journal of the ankle of the skier, when said spoiler is in a position of closure of the upper on the lower part of the leg, wherein said rear spoiler has at least one transverse indent open towards the outside of the boot at the side constituting the rear part of the upper, said indent extending along a plane intersecting a plane passing by the latching means and pivot of said rear spoiler, thus determining, on the one hand, an upper segment journalled on latching means in the zone of the journal of the ankle, and capable of pivoting frontwardly on said means, and on the other hand, a lower segment journalled on pivot of the rear spoiler in the zone of the heel on lower shell, this lower segment constituting, by its upper edge contiguous to the lower edge of the upper segment, a stop abutment stopping all rearward pivoting of said upper segment, as soon as the edges are in contact.

2. Ski boot as defined by claim 1, wherein the indent is made in the rear portion of the rear spoiler, said spoiler having a rigidification element extending in the vertical direction on the upper segment and on the lower segment, on both sides of said indent.

3. Ski boot as defined by claim 2, wherein the depth of the indent in the rear portion of the rear spoiler leaves a material wall constituting a bridge between the base of the indent and the lower edge of the wings of said spoiler.

4. Ski boot as defined by claim 3, wherein the bridge extending between the base and the indent and the lower edge of wings is adapted to flex elastically when the upper segment of the rear spoiler is pivotally biased frontwardly, whereas the lower segment remains retained on the lower shell by the journal axis of said rear spoiler.

5. Ski boot as defined by claim 1, wherein the edges of the indent are contiguous in the initial closing position of the rear spoiler on the upper of the boot.

6. Ski boot as defined by claim 1, wherein the edges of the indent are spaced from another by a certain value enabling the upper segment to pivot rearwardly about the latching means on sides of the upper, until said edges are in contact.

7. Ski boot as defined by claim 6, wherein a filler element equipped with retention means on the rear spoiler is adapted to fill the space left free between edges and indent.

8. Ski boot as defined by claim 7, wherein the filler element consists of retention means enabling it to be removed from the rear spoiler.

9. Ski boot as defined by claim 8, wherein the filler element is constituted of a rigid material.

10. Ski boot as defined by claim 8, wherein the filler element is constituted of an elastically compressible material.

11. Ski boot as defined by claim 1, wherein the sealing means are attached to the inner side of the rear spoiler and cover the indent.

12. Ski boot as defined by claim 11, wherein the sealing means are removable from the rear spoiler by means of bindings.

13. Ski boot as defined by claim 1, wherein the rear spoiler is provided with a rigidification element that extends in the vertical direction on the rear portion of said spoiler, of said upper segment up to the lower segment on both sides of the indent.

14. Ski boot as defined by claim 13, wherein a limitation element limiting the possible distancing of the indent in front flexion extends from upper segment to lower segment, that it connects to each other in the zone corresponding to the rigidification element, which consists of at least one recess of a certain length limited by a shoulder in the vicinity of edges of the indent, and enabling said limitation element to slide until it comes into abutment on said shoulders.

* * * * *